US006401634B1

(12) United States Patent
Anderson

(10) Patent No.: US 6,401,634 B1
(45) Date of Patent: Jun. 11, 2002

(54) METHOD OF TREATING COMBUSTIBLE MATERIALS WITH SODIUM SILICATE

(75) Inventor: Timothy J. Anderson, Encinitas, CA (US)

(73) Assignee: Envivotek Industries, LLC, Encinatas, CA (US)

( * ) Notice: Subject to any disclaimer, the term of this patent is extended or adjusted under 35 U.S.C. 154(b) by 0 days.

(21) Appl. No.: 09/560,053

(22) Filed: Apr. 27, 2000

Related U.S. Application Data

(60) Provisional application No. 60/131,646, filed on Apr. 29, 1999.

(51) Int. Cl.[7] ..... F23B 7/00; C10L 11/00
(52) U.S. Cl. ..... 110/342; 110/218; 44/542
(58) Field of Search ..... 110/218, 341, 110/342, 345, 344, 340; 44/542, 543, 550

(56) References Cited

U.S. PATENT DOCUMENTS 3,836,354 A * 9/1974 Wienert ..... 75/3
4,206,713 A * 6/1980 Ryason ..... 110/347
4,518,393 A * 5/1985 Pace et al. ..... 44/6
4,547,351 A * 10/1985 Im et al. ..... 423/242
4,941,888 A * 7/1990 Kramer ..... 44/541
5,893,946 A * 4/1999 Landis ..... 106/38.2

FOREIGN PATENT DOCUMENTS

GB 2155491 A * 3/1984

* cited by examiner

*Primary Examiner*—Ira S. Lazarus
*Assistant Examiner*—K. B. Rinehart
(74) *Attorney, Agent, or Firm*—Womble Carlyle Sandridge & Rice, PLLC

(57) ABSTRACT

The present invention provides a method for chemically treating combustible materials prior to combustion. Specifically the present invention is directed to a method for treating a combustible material like a coal briquette with a sodium silicate coating to provide a fuel source with greatly reduced pollutant emissions.

1 Claim, No Drawings

METHOD OF TREATING COMBUSTIBLE MATERIALS WITH SODIUM SILICATE

CROSS-REFERENCE TO RELATED APPLICATION

This application claims the benefit of U.S. Provisional Patent Application No. 60/131,646, filed Apr. 29, 1999.

FIELD OF THE INVENTION

The present invention generally relates to combustible materials. More particularly, the present invention relates to chemically treating combustible materials prior to combustion.

SUMMARY OF THE INVENTION

Briefly described, the present invention is a method of treatment of combustible materials with sodium silicate prior to combustion. The preferred combustible material is coal or lignite, and most preferably stoker coal. Sodium silicate is applied in aqueous form, preferably by spraying, to the coal to at least form a partial coating around the individual particles of coal. The treated coal is then preferably combusted in the burn chamber of a coal-fired boiler and has greatly reduced pollutant emissions.

The coating of sodium silicate greatly reduces particulate emissions, smoke, benzo-A-pyrene, and other noxious emissions. Dependent on the thickness and amount of sodium silicate applied to each individual piece of coal, noxious emissions can be reduced up to 100 times less than normal. Additionally, the water present in the aqueous sodium silicate significantly increases the boiler efficiency by increasing the combustion efficiency of the treated coal.

An object of the present invention is to provide a method of pretreating combustible materials which greatly reduces pollution emission when the materials are combusted.

Another object of the present invention is to provide a method of pretreating combustible materials which greatly enhances combustion efficiency when the materials are combusted.

Another object of the present invention is a fuel combustion process resulting in reduced pollution emission and enhanced combustion efficiency.

A further object of the present invention is to provide a treated fuel for combustion in a furnace.

Other objects, features, and advantages of the present invention will become apparent after review of the hereinafter set forth Detailed Description of the Invention.

DETAILED DESCRIPTION OF THE INVENTION

The present invention is a method of treating combustible materials, preferably coal or lignite, and most preferably stoker coal, prior to combustion in a furnace or boiler. In the preferred embodiment, stoker coal is subjected to a spray of aqueous sodium silicate upon the individual particles of the stoker coal prior to combustion in a coal-fired boiler. While the present method of treatment can be used on stoker coal of any size, it is preferred that the coals which are to be subject to the aqueous sodium silicate spray be no smaller than 20 mesh.

The application of sodium silicate to the stoker coal causes at least a partial coating to form therearound. Sodium silicate (such as $Na_2Si_4O_9$ or $Na_2SiO_3$) is a generic term for a family of chemicals comprised of sodium oxide ($Na_2O$), silica ($SiO_2$), and typically water ($H_2O$). Commercial grades of sodium silicate are readily available and fairly inexpensive. For purposes of the present invention, the preferred sodium silicate is "K" brand sodium silicate from the PQ Corporation. The data sheet (Exhibit A) and analysis certificate (Exhibit B) for K brand sodium silicate are attached hereto and incorporated herein by this reference. The concentration of sodium silicate in the aqueous form is preferably altered from the commercial concentration disclosed in the data sheet depending on final concentration and effect desired. However, the sodium silicate is preferably mixed to a maximum percentage of 10% sodium silicate by weight with neutral to slightly acidic water.

The sodium silicate is sprayed on the stoker coal briquettes in an amount ranging from 35 $ft^2$/gal to 250 $ft^2$/gal depending on porosity and size of the coal, and amount of coating desired. The square footage for spraying is determined mathematically from the size, shape, and volume of the combustible coal. To provide a thorough coating, 35 $ft^2$/gal will substantially cover the individual stoker coal particles to preferably form a solid coating therearound upon drying. While a minimal spray, e.g. 250 $ft^2$ or greater per gallon will sparsely cover the individual stoker coal particles, even such minimal coating still has value in reduction of pollutant emissions during combustion and enhanced physical burning characteristics.

EXAMPLE

Stoker coal in random shapes averaging 1–2 inches in approximate diameter are coated with "K" brand sodium silicate prior to combustion. The "K" brand sodium silicate is sprayed in an aqueous solution of 10% sodium silicate solids concentration in neutral to slightly acidic water. The coal is coated such that the surface area of the coal is sprayed with 50 $ft^2$/per gallon of the above "K" brand sodium silicate.

While there has been described a preferred embodiment of the present invention, it is to be understood that certain changes may be made by one skilled in the art in the performance of the steps, and in composition of the elements herein without departing from the underlying scope of this invention as set forth in this disclosure.

I claim:

1. A method for treating a combustible briquette comprising the steps of:

obtaining a combustible briquette;

applying a sodium silicate coating onto said briquette, wherein the sodium silicate coating is applied as an aqueous spray, wherein the sodium silicate aqueous spray is applied to the briquettes in an amount ranging from about 35 $ft^2$ per gallon to about 250 $ft^2$ per gallon;

drying a coated briquette for such time as required to form a solid coating of sodium silicate on the briquette; and burning the coated briquette in a burn chamber.

* * * * *